US005546610A

United States Patent [19]

Herzig et al.

[11] Patent Number: 5,546,610

[45] Date of Patent: Aug. 20, 1996

[54] FASTENING SYSTEM FOR FASTENING A FACE-PROTECTION SHEILD AND/OR HEARING PROTECTION CAPS TO A WORK HELMET

[75] Inventors: Kurt Herzig, Liestal; Hugo Herzig, Lausen, both of Switzerland

[73] Assignee: Artilux Herzig AG, Liestal, Switzerland

[21] Appl. No.: 314,907

[22] Filed: Sep. 29, 1994

[30] Foreign Application Priority Data

Sep. 30, 1993 [CH] Switzerland ..... 2942/93

[51] Int. Cl.[6] ..... A42B 3/16; A42B 3/18

[52] U.S. Cl. ..... 2/422; 2/423; 2/424

[58] Field of Search ..... 2/8, 9, 10, 11, 2/15, 410, 422, 423, 424

[56] References Cited

U.S. PATENT DOCUMENTS

| | | | |
|---|---|---|---|
| 3,075,201 | 1/1963 | Lindblom | 2/8 |
| 4,104,743 | 8/1978 | Bottger | 2/423 |
| 4,287,614 | 9/1981 | Lonnstedt | 2/423 |
| 4,347,631 | 9/1982 | Newcomb | 2/423 |
| 4,375,702 | 3/1983 | Lundin | 2/423 |
| 4,479,738 | 10/1984 | Kubnick | 2/424 |
| 4,536,892 | 8/1985 | Brinkhoff et al. | 2/424 |
| 4,621,3277 | 11/1986 | Pennell | 2/10 |

FOREIGN PATENT DOCUMENTS

| | | | |
|---|---|---|---|
| 2260311 | 12/1972 | Germany . | |
| 7335724 | 9/1973 | Germany . | |
| 7415619 | 5/1974 | Germany . | |
| 7523571 | 7/1975 | Germany . | |
| 2705348 | 2/1977 | Germany . | |
| 5163604 | 6/1993 | Japan | 2/424 |
| 1301372 | 4/1987 | U.S.S.R. | 2/423 |

*Primary Examiner*—Michael A. Neas
*Attorney, Agent, or Firm*—Leydig, Voit & Mayer

[57] ABSTRACT

The proposed fastening system for adjustably holding a face-protection shield and/or hearing-protection caps is distinguished by the use of efficiently producible and mountable plastics parts. The carrying straps (110) are latched onto coupling cams, whereby at least two positions—face-protection shield lowered or raised—can be stably set. The holding straps (150) bearing the hearing-protection caps can be clamped and unclamped. The locked adjustment positions are made possible by a combination of a crook (152) located at the end of the holding strap (150) and a counteracting spring bar having a boss profile (149), which combination acts as a switch. If no use of the hearing-protection caps is to be made for some time, the holding straps (150) can be swivelled towards the rear. The system is well protected against dirt contamination, loose parts are avoided and, as a result of the sole use of plastic, the system is also suitable for the electrical field.

21 Claims, 5 Drawing Sheets

Figure 1B:
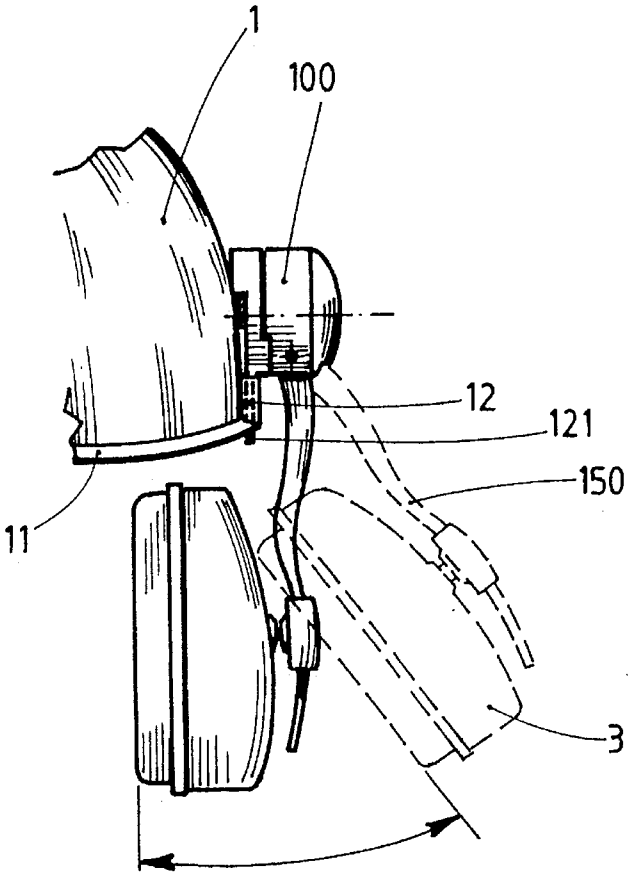

FASTENING SYSTEM FOR FASTENING A FACE-PROTECTION SHEILD AND/OR HEARING PROTECTION CAPS TO A WORK HELMET

The invention relates to a fastening system, provided on both sides of a protective helmet, for adjustably holding a face-protection shield and/or hearing-protection caps.

There are a large number of fields of work in which a protective helmet having additional hearing and/or face protection has to be worn, for instance often in the construction or forestry industries where motor saws are operated. The personal protection requirements of the actual persons engaged in the work, as well as regulations, demand that there are protective helmets available which can be worn in combination with the said protective devices. It is not just a matter here of mere functionality, but also of wearing and operating comfort. In order to prevent the protective helmet and the hearing and face protection from having to be separately mounted, worn and handled, designs immediately appeared on the market whereby the additional protective devices were fastened to the helmet.

A holding fixture is known, which on both sides of the protective helmet is fixed to the helmet by means of a screw connection which passes through its wall (German Offenlegungsschrift 22 60 311; German utility model 73 35 724). A drawback with this design, apart from the increased production complexity, is an often inadmissible weakening of the helmet shell as a result of the two pass-through bores and any sight-protection to be worn would need to be put on separately.

Additionally, a holding frame is known which surrounds the rim of a protective helmet and to which there are fitted face and hearing protections (DE-GM 75 23 571). In this version, although the piercing of the helmet shell is avoided, the design is nevertheless very complex and the handling of the head-protection elements—helmet, face and hearing protection—in combination proves to be awkward.

Clamping parts have also been developed which have to be fixed to the helmet rim, the clamping parts receiving carrying straps for the hearing-protection caps (German utility model 74 15 619; German patent specification 27 05 348). These clamping parts are relatively simple in terms of their constructional design, but they are only suitable for holding a carrying strap. The simultaneous attachment of a face and hearing protection is not possible.

Those fastening devices which are hitherto known on work helmets for the fixing of face and hearing-protection elements cannot as a whole be considered ideal. For this reason, the invention pursues the objective of providing a fastening system to which both the carrying straps for a sight protection and the holding straps for hearing-protection caps can be simultaneously attached. The handling of the head-protection elements must prove to be simple and secure. The entire protective system should also be capable of being used in the electrical field. Furthermore, the fastening device must be of a certain robustness and must be adequately protected against dirt contamination. Moreover, the constructional design has to enable it to be cheaply produced. For particular applications in which this will suffice, the fastening system, in a less complex design, should allow only the reception of a face-protection shield or of hearing-protection caps.

To begin with, the invention is based upon the principal application, namely that the fastening system is designed to hold both the face-protection shield and hearing-protection caps. The new-type fastening system offers considerable advantages over the previous prior art. The use of a protective helmet equipped with this fastening system is shown to be advantageous. The relatively small, compact and lighter construction and the functioning of the system results in an optimal contact pressure of the hearing-protection caps in the state in which they are clamped against the ears, in an improved unclamping facility—distanced from the ears—and pivotability in the direction of the back of the head. Similarly, the pivotability of the face-protection shield between the two end positions "lowered—shielding the face" and "raised—exposing the face" is also improved. The constructional design of the fastening system enables a balanced weight distribution of the applied protective devices, so that their stable positioning in the respective swivel position is guaranteed and no detectable load variations for the helmet-wearer are obtained. The system exhibits no metal parts whatsoever, so that a protective helmet which is thus equipped can also be used in electrical work. The holding and carrying straps for the hearing-protection caps and the face-protection shield respectively no longer have to be distinguished on the basis of left and right parts. In general, the protective helmet is used both with the applied hearing-protection caps and with the face-protection shield, for example in forestry work involving motor saws. For fields of work in which this combination is unnecessary, the non-required protective device can be swivelled away using a handle. The fastening system, by virtue of its capsule-like construction, is ideally protected against dirt contamination and against tampering. There are no parts which are in any way relatively loosely suspended, for example a tension spring, which might get lost. Finally, it should also be noted as an important advantage that the new fastening system can be produced substantially more cheaply than known devices.

Figure 1A:
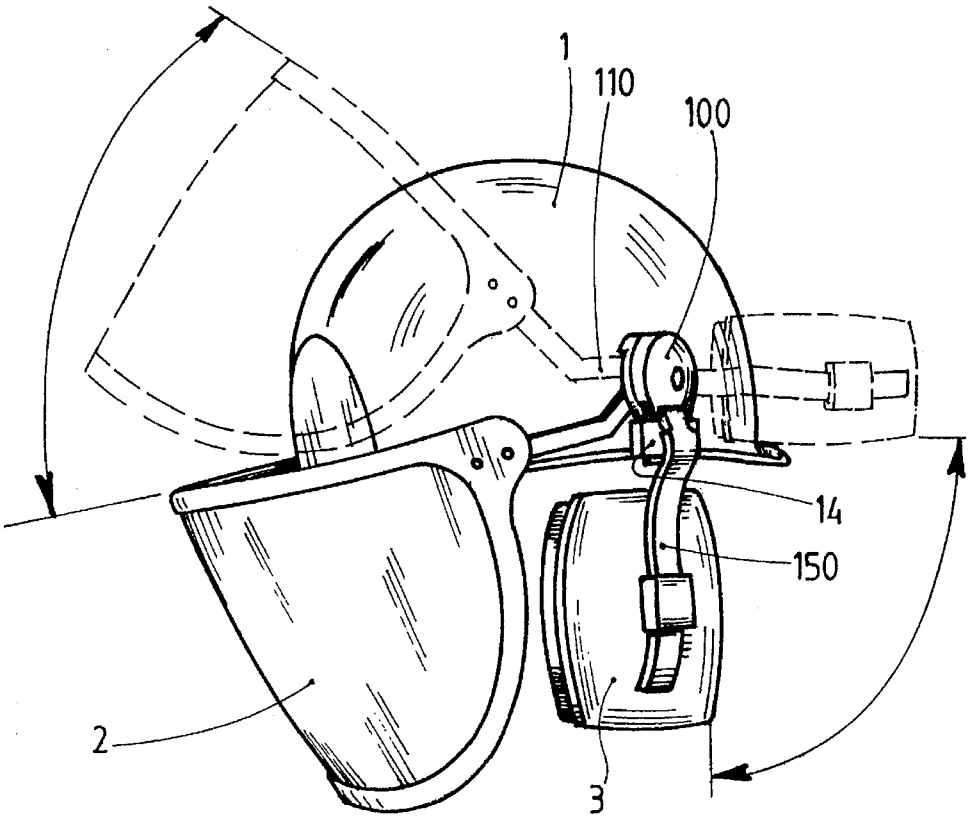
Figure 1C:
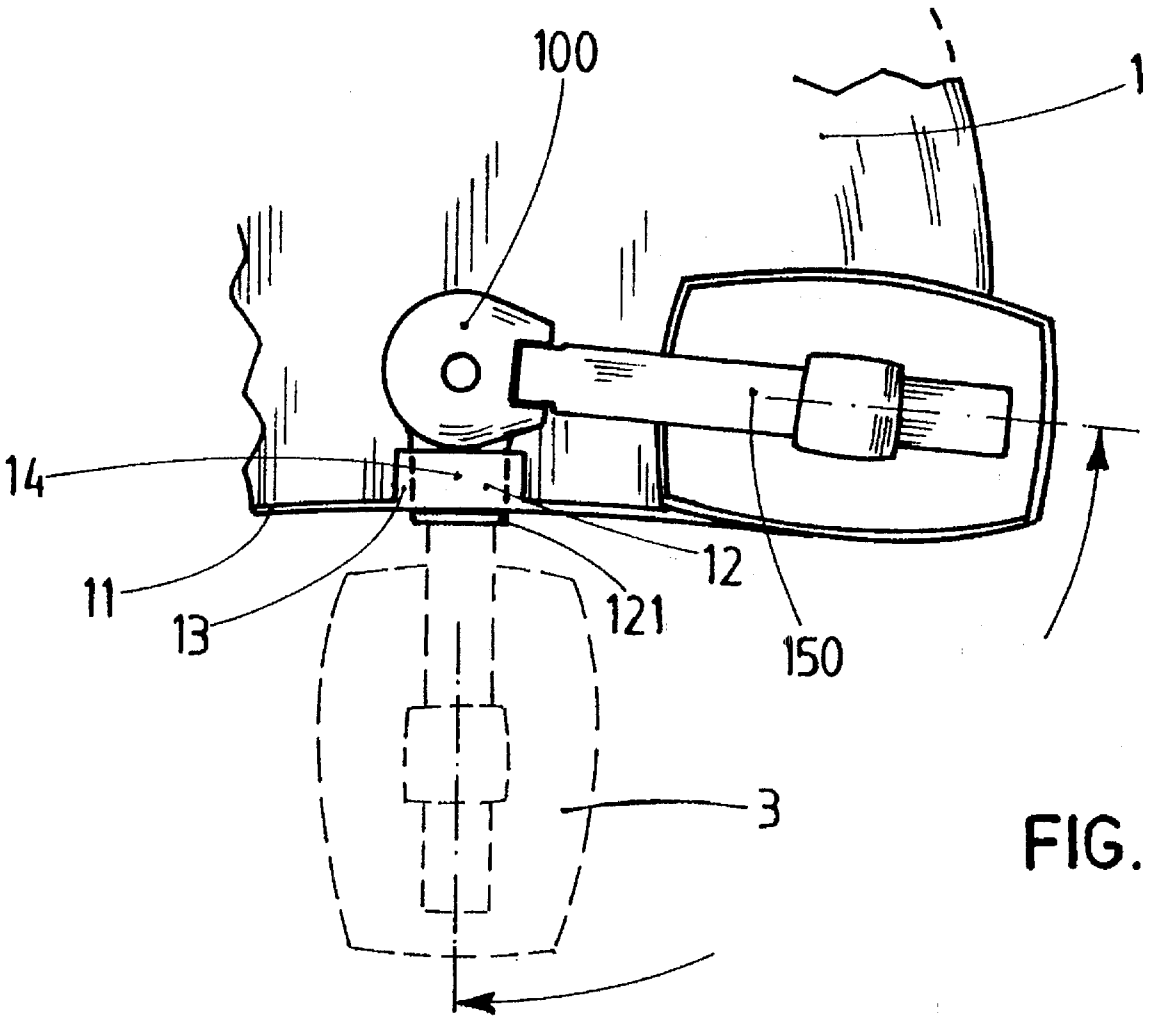
Figure 2B:
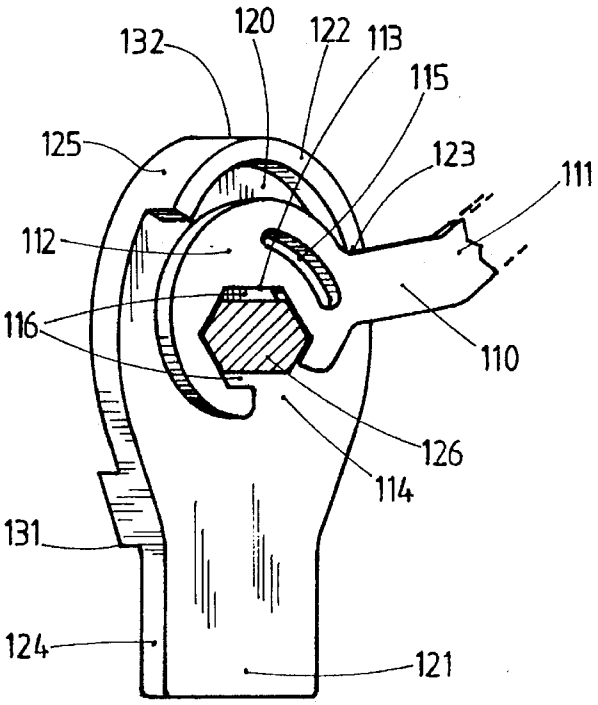
Figure 2C:
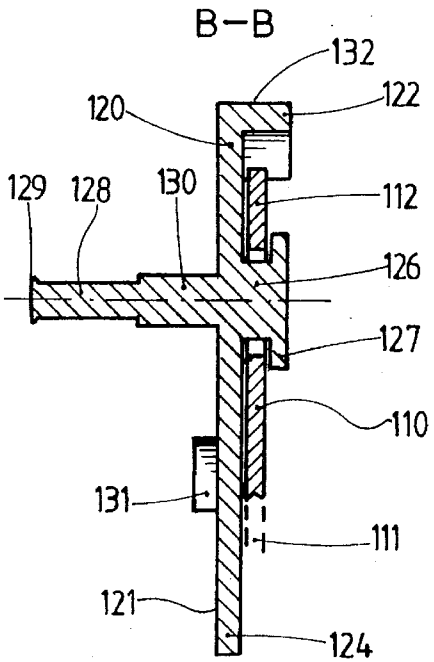
Figure 2A:
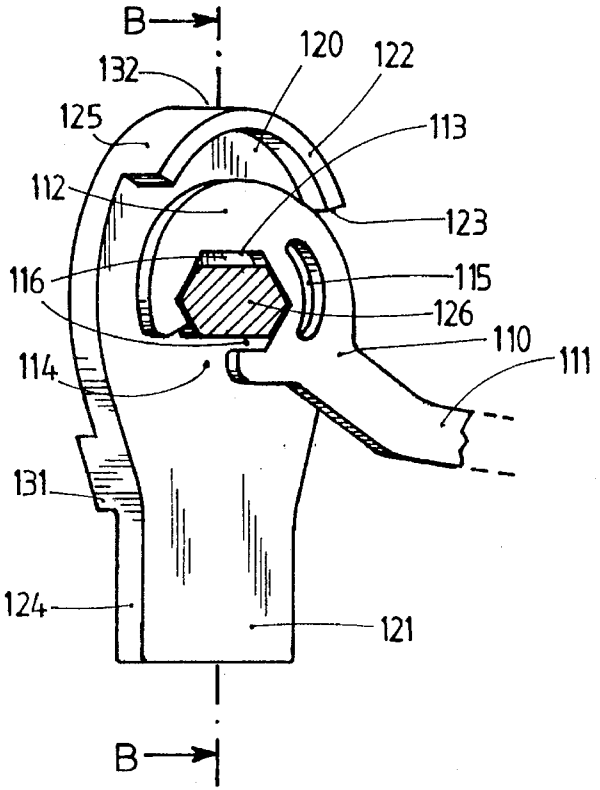
Figure 3C:
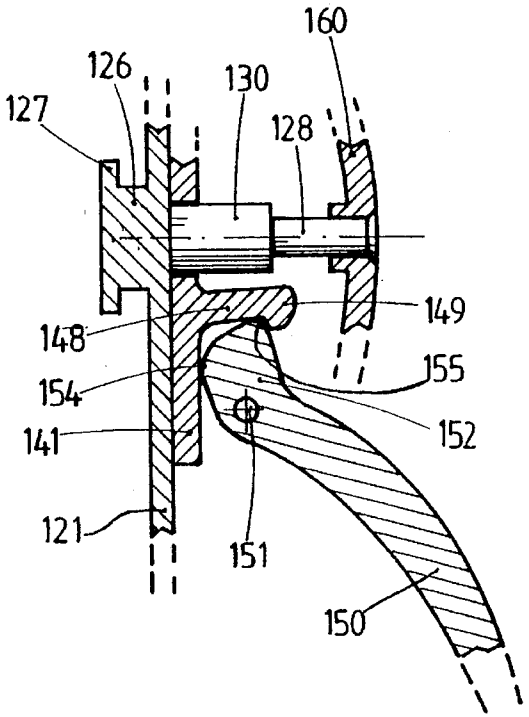
Figure 3B:
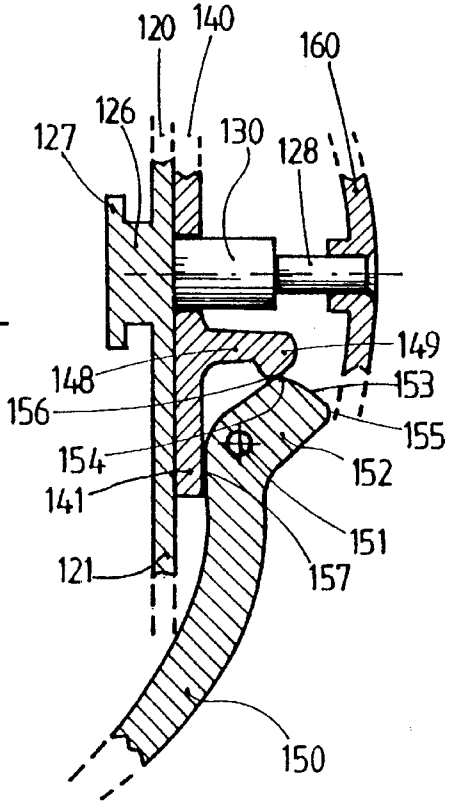
Figure 3A:
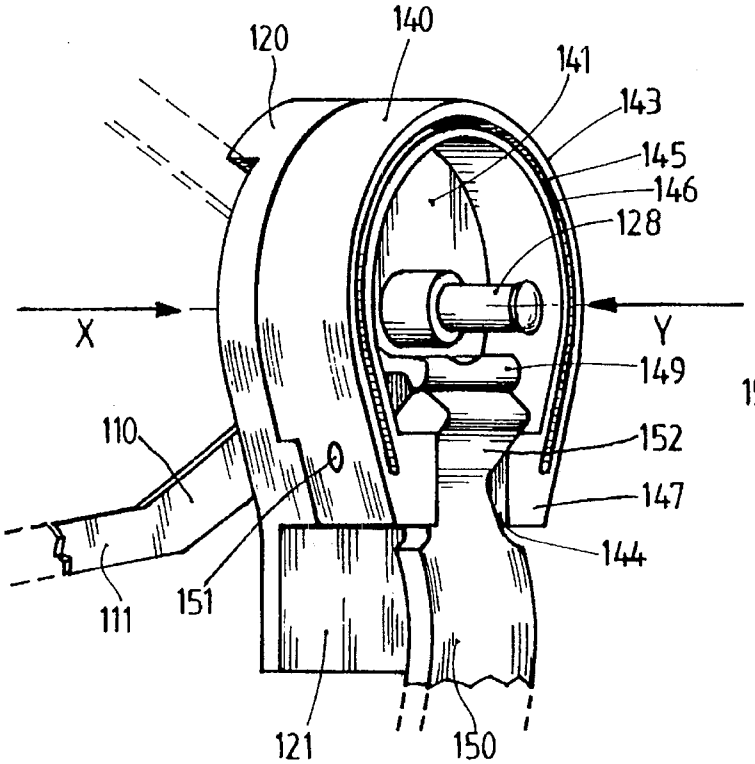
Figure 3D:
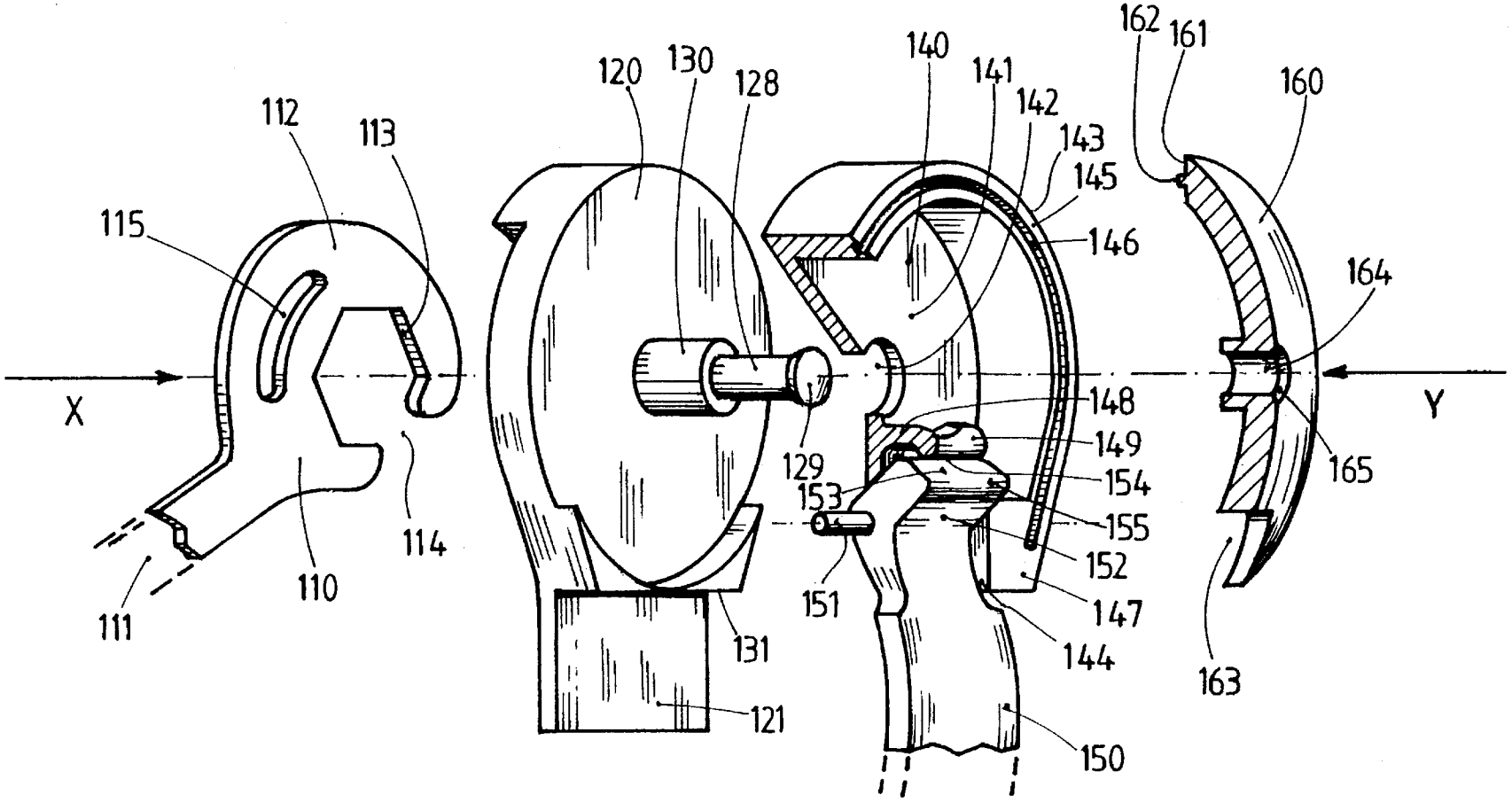

An illustrative embodiment of the fastening system according to the invention is described in detail below with reference to the appended drawings, in which:

FIG. 1 shows perspective projections displaying protective devices on the protective helmet;

FIG. 1*a* shows a protective helmet displaying applied hearing-protection caps and an applied face-protection shield in the respective end positions;

FIG. 1*b* shows a hearing-protection cap in clamped and unclamped position;

FIG. 1*c* shows a hearing-protection cap in rearward-swivelled position;

FIG. 2 shows representations of the carrying strap plate, a projection from the X-side displaying a carrying strap for the face-protection shield;

FIG. 2*a* shows a carrying strap in the locked position "face-protection shield lowered";

FIG. 2*b* shows a carrying strap in the locked position "face-protection shield raised";

FIG. 2*c* shows a section according to FIG. 2*a* along line B—B;

FIG. 3 shows representations of the fastening system, a projection from the Y-side displaying a holding strap for the hearing-protection cap and a carrying strap for the face-protection shield;

FIG. 3*a* shows a perspective projection of the locking mechanism for the holding strap;

FIG. 3*b* shows a sectional representation of the holding strap in the clamped position;

FIG. 3*c* shows a sectional representation of the holding strap in the unclamped position;

FIG. 3*d* shows an exploded representation, partially cut.

According to FIGS. 1*a* to 1*c*, the protective helmet 1 exhibits on its bottom edge, in the outwardly extending helmet rim 11 on both sides, a respective, vertically running insertion groove 12 passing through the helmet rim 11, which insertion groove is surrounded by upwardly erect bars 13. The insertion grooves 12 are disposed perpendicularly over the ears of a potential helmet-wearer. Into the two insertion grooves 12 there is inserted a respective fastening device 100, to be precise by an insertion tab 121 extending perpendicularly downwards from the fastening device 100, the insertion tab 121 penetrating into the insertion groove 12 from above and being guided therein. The guidance of the insertion tab 121 in the insertion groove 12 is reinforced by the bars 13 surrounding the insertion groove 12, thereby producing a type of guide sleeve 14. To each fastening device 100 there is fixed a respective carrying strap 110 —the left and right respectively—of the face-protection shield 2 and a respective holding strap 150 for the respective left or right hearing-protection cap 3. In accordance with the momentary requirements, the face-protection shield 2 can be lowered (FIG. 1*a*: continuous-line representation) or raised (dashed representation). The hearing-protection caps 3 can assume three different positions: clamped against the ears of the wearer (FIGS. 1*a* and 1*b*: continuous-line representation), unclamped from the ears of the wearer (FIG. 1*b*: dashed representation) and, finally, swivelled towards the rear (FIG. 1*a*: dashed representation; FIG. 1*c*: continuous-line representation). Locks within the fastening device 100, which locks shall further be described, give rise to a stable positioning of the face-protection shield 2 and of the hearing-protection caps 3, so that an unwanted adjustment—e.g. resulting from jerky movements —is in any event prevented. With a certain force influence, however, the carrying straps 110 with the face-protection shield 2 fastened thereto and the holding straps 150 with the hearing-protection caps 3 fixed thereto are able to be adjusted.

FIGS. 2*a* and 2*b* show the carrying strap plate 120 of the fastening device 100 in the projection X, i.e., the face facing the protective helmet 1. The sectional representation according to FIG. 2*c* is intended to illustrate the overall structure of the carrying strap plate 120. In FIG. 2*a*, the arm 111 of the carrying strap 110 is lowered, while in FIG. 2*b* the arm 111 is raised. The one-piece carrying strap plate 120 is approximately oval in shape and extends downwards as an insertion tab 121 exhibiting the parallel-running side flanks 124. The insertion tab 121 is dimensioned such that the plug connection between the insertion tab 121 and the guide sleeve 14 guarantees a secure fixing of the fastening device 100 to the protective helmet 1, but an occasional withdrawal of the insertion tab 121 from the guide sleeve 14 is also possible with a certain force expenditure. In the uppermost region and adjacent to the rim of the carrying strap plate 120, there is mounted in segment-like fashion, approximately over a radian measure of 90°, a supporting edge 122, which terminates with the outer flank 125 of the carrying strap plate 120, the supporting edge 122 extending from the apex line 132 of the carrying strap plate 120 approximately equally far in both directions. This supporting edge 122 has two functions. As a result of the supporting edge 122, for instance, which thickens the uppermost region of the carrying strap plate 120, the surface curvature of the protective helmet 1, which surface curvature leads away from the perpendicularly inserted fastening device 100, is offset. The supporting edge 122 causes the fastening device 100 to bear in a play-free manner against the protective helmet. One of the cross-sectional faces of the supporting edge 122, namely that which is facing the transition between the arm 111 and the claw 112 of the carrying strap 110, serves as a stop 123 whenever the carrying strap 110 is raised.

From the centre of the carrying strap plate 120 there rises a coupling cam 126—here having the cross-sectional shape of a hexagon—which is enclasped by the claw 112 of the carrying strap 110. The coupling cam 126 is of a height corresponding at least to the material thickness of the claw 112, the material thickness of the total carrying strap 110 being determined on the basis of the strength requirement and the spatial conditions. Seated on the coupling cam 126, in the shape of a lid, there is a holding disc 127; the coupling cam 126 and the holding disc 127 can expediently form a transition-free part here. The holding disc 127 has the task of preventing the claw 112 and hence the total carrying strap 110 from sliding down from the coupling cam 126 and perpendicularly from the carrying strap plate 120. The coupling cam 126 and the inner contour 113—here a hexagonal recess—of the claw 112 possess a geometry which is roughly mutually complementary. The claw 112 is configured in the style of an open-jawed spanner, the jaw opening 114 extending in the present variant in the downward direction. The claw 112 further exhibits a groove-shaped elastic recess 115. This passes through the material thickness of the claw 112 and stretches approximately from the transition between the claw 112 and the arm 111 partially into the arc-shaped course of the claw 112. The function of the elastic recess 115 is that, upon the mounting and removal of the carrying strap 110, more precisely of the claw 112 onto the coupling cam 126, and upon the adjustment of the mounted carrying strap 110, the jaw opening 114 tends to widen and the operations are thereby facilitated. The coupling cams 126 and the inner contour 113 are dimensioned relative to one another in such a way that a tight seat is obtained. Corners and flanks of the inner contour 113 of the claw 112 are forced against the corresponding corners and flanks of the coupling cam 126. When the carrying strap 110 is adjusted from the lowered into the raised position or vice versa, a partial twisting of the claw 112 about the fixed coupling 126 cam takes place. As the twisting occurs, the jaw opening 114, as well as the claw 112 per se, is expanded somewhat by the coupling cam 126, until, upon a continuing rotary motion, between the inner contour 113 and the coupling cam 126, a next latching position is obtained. The expansion and contraction of the claw 112 is substantially promoted by the elastic recess 115. In the geometric match between the inner contour 113 and the coupling cam 126, it is advantageous, in order to facilitate the adjustment of the carrying strap 110, to provide remaining air gaps 116 in the composite comprising the coupling cam 126 and the claw 112 enclasping the latter.

For the interplay between the coupling cam 126 and the inner contour 113, apart from the geometry described here—the hexagon—the widest variety of shapes enter into consideration. Other polygons—from the rectangle upwards—are thus conceivable, as are various toothing shapes having teeth of wedge-shaped or rounded pattern. It is critical that when the claw 112 is twisted—i.e. when the carrying strap 110 is adjusted in either direction, the claw 112 initially expands, so that an adjustment is actually possible, and then, at the desired height of the carrying strap 110, a sufficiently stable latching position is reassumed.

It can be seen from FIGS. 2*c* and 3*d* that the carrying strap plate 120 from the projection Y, i.e. the face facing away from the protective helmet 1, likewise exhibits particular design features. Rising from the centre of the carrying strap plate 120, lying opposite the coupling cam 126 and extending into the interior of the fastening device 100, there is a pin 128 having a locking boss 129 and a base thickening 130. At the transition to the insertion tab 121 there is configured a seating edge 131 which, in the manner of a shoulder, reinforces the carrying strap plate 120. The fastening device 100, when inserted into the guide sleeve 14, is supported against the seating edge 131. Where the shape of the protective helmet 1 so permits, the seating edge 131 could also be configured on the X-projection side. The pin 128, its locking boss 129 situated at its tip and its base thickening 130, which is configured from the base of the pin 128, bring about the fixing and cohesion of the holding strap plate 140 and of the cover 160 to the carrying strap plate 120.

The total carrying strap plate 120 with the insertion tab 121 and with the described structural parts on the projection sides X and Y is advantageously produced as a one-piece plastics moulding, e.g. by injection-moulding methods.

Also forming part of the fastening device 100 is the holding strap plate 140, which is disposed between the above-described carrying strap plate 120 and the cover 160. The holding strap plate 140, in the completed state of the fastening device 100, is slid in contact-bearing arrangement onto the carrying strap plate 120, the pin 128 jutting through the pass-through bore 142 located in the centre of the base 141 of the holding strap plate 140 and the base thickening 130 of the pin 128 being seated in positive-locking connection in the pass-through bore 142. In the base 141 of the holding strap plate 140 there is located—from the projection side X—a recess which is complementary to the seating edge 131 of the carrying strap plate 120, so that the total base 141 bears positively against the carrying strap plate 120. In terms of the outer flank 125 and the vertical line 132, congruence exists between the carrying strap plate 120 and the holding strap plate 140, the holding strap plate 140 terminating at the seating edge 131.

According to FIG. 3*d*, from the projection side Y, the holding strap plate 140 exhibits further layout features. Rising from the rim of the base 141 there is an almost fully encircling side wall 143 possessing, solely for the holding strap 150 reaching from below into the holding strap plate 140, an aperture 144, as a result of which the holding strap 150 is laterally guided. On the top edge 145 of the side wall 143 there encircles a positioning and sealing groove 146. In the region of the aperture 144 and on its two sides, the side wall 143 has a wall thickening 147, since the rotational axis 151 of the holding strap 150 is embedded in it. The holding strap 150 is suspended from the horizontally running rotational axis 151 and can be swivelled about this between the two adjustment positions—clamped and unclamped position respectively. Rising up from the base 141, beneath the pass-through bore 142, to about the top edge 145 of the side wall 143 there is a spring bar 148, having a boss profile 149 at its tip. It is also conceivable that the spring bar 148 does not rise up from the base 141, but that a spring bar 148 of this kind projects as a tongue from the side wall 143 or is clamped on between the encircling side wall 143.

Reaching up to the spring bar 148 and such that it is in contact with the boss profile 149, there is a crook 152, which, in the clamped position of the holding strap 150 (see FIGS. 3*a*, 3*b* and 3*d*), is cranked in the direction of the mounted cover 160 and forms an end piece of the holding strap 150. The crook 152 possesses, on its foremost flank, a horizontally running slide face 153, which is limited by two rounded trip edges 154, 155.

Onto the holding strap plate 140 there is placed, finally, a curved cover 160 possessing a cover rim 161, which fits the top edge 145 and the positioning and sealing groove 146 located therein and has a correspondingly projecting sealing boss 162. The cover 160 further exhibits in the lower marginal region, which makes its way, via the base of the crook 152, to the residual holding strap 150, a jog 163, so as to prevent the holding strap 150, when swivelled into the unclamped position, from being obstructed by the cover 160. In the centre of the cover 160 there is additionally provided a pass-through bore 164 having an outer countersinking 165.

In the assembled state, the cover rim 161 lies on the top edge 145 of the holding strap plate 140; the sealing boss 162 here engages in the positioning and sealing groove 146. The tip of the pin 128 having the front-located locking boss 129 has to squeeze through the pass-through bore 164 in the cover 160, finally latches in the countersinking 165 and thus draws to it the cover 160, whereby the holding strap plate 140 also is forced against the carrying strap plate 120 and hence the composite of the fastening device 100 is formed. It is also feasible, in place of the pass-through bore 164 in the cover 160, to provide a blind-hole bore having a widening in which the locking boss 129 catches, so that the cover 160, once mounted, is made much more difficult to remove. This design can be expedient where it is important to prevent the fastening device 100 from being opened without permission. Where there is a low risk of dirt contamination, it is also possible, in place of an encircling, closed side wall 143, simply to provid bars for the support of the cover 160. It is also conceivable to do without the side wall 143 and, in return, to extend the cover rim 161 such that between the base 141 and the cover 160 there is thereby formed a cavity for the crook 152 and for the spring bar 148.

Like the carrying strap plate 120, the holding strap plate 140 and the cover 160 are also advantageously produced as one-piece plastics mouldings, e.g. by injection-moulding methods; the same applies to the carrying straps 110 and the holding straps 150.

There now follows the description of the working of the fastening device 100 in respect of the clamping and unclamping of the holding strap 150 with the hearing-protection cap 3 located thereon and of the swivelling of the holding strap 150 towards the rear.

Hearing-protection cap 3 bearing against the ear of the wearer—clamped position—(FIG. 3*b*)

This adjustment position means that the holding strap 150 is running approximately perpendicularly downwards from the fastening device 100. Furthermore, the spring bar 148 is bent to a certain extent upwards out of its rest position by a contact flank 156 on the crook 152, which contact flank, from the slide face 153, is situated behind the trip edge 154 and presses against the underside of the bulbous boss profile 149. Viewed on the perpendicular, the contact flank 156, as a result of the bevels on the crook 152, is situated a touch lower than the trip edge 154, which in this adjustment position forms a ridge line. In the setting of this position, the underside of the boss profile 149 has sprung over the trip edge 154. A maximum deflection of the spring bar 148 and hence also a peak value in terms of spring force has been exceeded, so that the holding strap 150 stays put in this adjustment position. According to the Newtonian "actio et reactio" reaction principle, the underside of the boss profile 149 presses for its part upon the contact flank 156 of the crook 152 and, by virtue of the fact that the rotational axis 151 of the holding strap 150 lies on the x-coordinate, to the left of the contact flank 156, the compressive force of the spring bar 148 is converted into a leftward-directed deflection force acting upon the holding strap 150 and the hearing-protection cap 3 is thus pressed against the ear of the wearer. In order to prevent the holding strap 150 from otherwise —e.g. when the protective helmet 1 is taken off swinging in an erratic manner further to the left, i.e. below the minimum anatomical ear span of a wearer, the holding strap 150, when reaching this position, butts with a stop face 157 against the rim of the base 141. The compression force of the hearing-protection cap 3 against the ear of the wearer is approximately constant within the possible anatomical ear spans and is dimensioned according to standard requirements.

Hearing-protection cap 3 removed from the ear of the wearer—unclamped position—(FIG. 3*c*)

This adjustment position implies that the holding strap 150 is jutting obliquely out of the fastening device 100. From the clamped position, the holding strap has been moved outwards, with a certain force expenditure, in a swivel motion. The spring bar 148 here lifts up a little and the spring force increases, since the trip edge 154 is situated higher than the contact flank 156. Upon further adjustment, the boss profile 149 travels onto the slide face 153. Since the latter, viewed on the y-coordinate, is situated beneath the trip edge 154, the spring bar 148 springs in the direction of its rest position. If the slide face 153 is further traversed, the spring bar 148 is once again deflected upwards, since, as a result of the adjustment of the crook 152, the lever arm is extended from the rotational axis 151 to the underside of the boss profile 149, whereby the spring bar is automatically forced successively further upwards. The boss profile 149 attains the maximum deflection and spring force when the trip edge 155 passes the underside of the boss profile 149. The boss profile 149 then springs from the previously traversed slide face 153 and the trip edge 155 which has just been passed to behind the latter, enclasping it, whereupon the spring bar 148 also drops abruptly. The trip edge 155, viewed on the x-coordinate, is situated to the left of the boss profile 149 and the holding strap 150 stays put in this adjustment position. Only when the holding strap 150 swivels to the left and the friction between the crook 152 and the boss profile 149 is surmounted and the peak value in terms of deflection and spring force of the spring bar 148 is overcome, is reassumption of the clamped position possible.

Hearing-protection cap 3 removed from the ear of the wearer—rearward-swivelled position—(FIG. 1*c*)

From the unclamped position, it is possible to swivel the hearing-protection cap 3 located on the holding strap 150 from close to the ear towards the rear. This, in turn, applies equally of course to both fastening devices 100 fitted to the protective helmet 1. By virtue of the tightly mounted cover 160 on the pin 128, the holding strap plate 140 is forced against the carrying strap plate 120. Those faces of the two latter plates which here bear against each other exhibit a certain roughness, so that a frictional grip is obtained. Under the influence of force, the carrying strap plate 120 and the holding strap plate 150 can be mutually twisted—the pin 128 becoming the rotational axis. This enables the hearing-protection cap 3 to be precisely positioned on the ear, but also to be swivelled towards the rear. The friction ratios are herein dimensioned such that the twisting can be effected with a reasonable force expenditure, whilst at the same time no automatic twisting, e.g. resulting from violent movement of the worker, takes place.

Putting on and removing the head-protection elements

The putting on and removal of the face-protection shield 2 and of the hearing-protection caps 3 is carried out by inserting or withdrawing the two fastening devices 100 into or from the protective helmet 1 by the pairs of carrying straps 110 and holding straps 150 which are already fixed to the fastening devices 100 and to which the face-protection shield 2 and the hearing-protection caps 3 respectively are fastened. There is therefore no need additionally to provide an over-simple way of putting on and removing of the face-protection shield 2 and of the hearing-protection caps 3, which are suspended from the carrying straps 110 and from the holding straps 150 respectively, directly onto or from the fastening devices 100.

For particular applications, it may be sufficient to fix in a fastening device either the carrying strap 110 for holding the face-protection shield 2 or just the holding strap 150 with the attached hearing-protection cap 3. Measured by the reduced functioning of such a fastening device, this is simplified as follows.

Holding of the face-protection shield 2 only

If just the holding facility for the face-protection shield 2, i.e. of a respective carrying strap 110 in a fastening device, is to be provided, then such a fastening device can be greatly simplified in design terms. One can even confine oneself to using a simplified carrying strap plate 120'. The previously described structure of the carrying strap plate from the projection X remains unaltered, whereas the pin 128, including the base thickening 130, on the Y-projection side is not required. For the present application, it is consequently sufficient to place a respective, thus simplified carrying strap plate 120', by its insertion tab 121, into the guide sleeves 14 provided on both sides of the protective helmet 1 and in each case to latch the carrying strap 110, with the claw 112, onto the coupling cam 126. It is also in this case conceivable to fit the coupling cam 126 with the mounted holding disc 127, instead of on the X-projection side, on the Y-projection side and then to latch on the claw 112 there.

Holding of the hearing-protection cap 3 only

If just the holding facility for a hearing-protection cap 3, i.e. of a respective holding strap 150 in a fastening device, is to be provided, then here too it is possible to simplify the design. Since-no carrying strap 110 for the fastening of the face-protection shield 2 has to be fixed to the carrying strap plate 120", on the X-projection side the coupling cam 126 and the holding disc 127 could be totally omitted.

We claim:

1. A head protection arrangement comprising:

a protective helmet;

a first strap support plate mounted on a lateral side of the helmet and having a first side facing the helmet, a second side facing away from the helmet, and a coupling cam formed on one of the sides and having a multisided outer contour; and a face-protection shield including a strap having a claw for grasping the coupling cam and having a multisided inner contour complementary to the outer contour of the coupling cam, the claw being shaped like an open-jawed spanner and having a jaw opening and a recess facilitating elastic expansion of the jaw opening, the inner contour of the claw being spaced from the outer contour of the coupling cam by an air gap, the shield being pivotable about the cam between a raised position and a lowered position in which the shield protects a face of a wearer of the helmet and being stably locked in either position by engagement between the cam and the claw.

2. An arrangement according to claim 1 wherein:

the helmet includes an outwardly extending rim and a guide sleeve extending upward from the rim; and the first strap support plate comprises an insertion tab detachably insertable into the guide sleeve, a seating edge adjoining the insertion tab for seating on the guide sleeve, and a supporting edge extending from an uppermost region of one of the sides of the first strap support plate along an arc and forming a stop for the strap when the face protection shield is in its raised position.

3. An arrangement according to claim 2 wherein the insertion tab engages an insertion groove passing through the rim.

4. An arrangement according to claim 1 wherein the outer contour of the coupling cam and the inner contour of the claw are each polygonal with at least four sides.

5. An arrangement according to claim 1 wherein the outer contour of the coupling cam and the inner contour of the claw have teeth formed thereon for mutual engagement.

6. A head protection arrangement comprising:

a protective helmet;

a first strap support plate mounted on a lateral side of the helmet and having a first side facing the helmet, a second side facing away from the helmet, a pin projecting from the second side, and a coupling cam formed on the first side and having a multisided outer contour;

a face-protection shield including a strap having a claw for grasping the coupling cam and having a multisided inner contour complementary to the outer contour of the coupling cam, the shield being pivotable about the cam between a raised position and a lowered position in which the shield protects a face of a wearer of the helmet and being stably locked in either position by engagement between the cam and the claw;

a second strap support plate mounted on the pin of the first strap support plate; and a hearing protection cap for protecting an ear of the wearer of the helmet and including a strap pivotably supported by the second strap support plate for movement towards and away from the ear of the wearer of the helmet between a first position in which the hearing protection cap covers the ear of the wearer and a second position in which the hearing protection cap is spaced from the ear of the wearer.

7. An arrangement according to claim 6 wherein the second strap support plate includes a spring bar resiliently contacting the strap of the hearing protection cap and resiliently maintaining the hearing protection cap in the first or second position.

8. An arrangement according to claim 6 including a cover mounted on the pin over the second strap support plate and restricting movement of the second strap support plate in an axial direction of the pin.

9. An arrangement according to claim 8 wherein the cover is detachably mounted on a boss formed on an end of the pin.

10. An arrangement according to claim 6 wherein the second strap support plate is pivotable about an axis of the pin to enable the hearing protection cap to be pivoted towards a rear of the helmet.

11. An arrangement according to claim 6 wherein the second strap support plate includes a side wall substantially surrounding the pin and extending away from the first strap support plate and having an aperture through which the strap of the hearing protection cap extends and which guides the strap of the hearing protection cap as the cap pivots between the first and second positions.

12. An arrangement according to claim 11 wherein the side wall increases in thickness adjoining the strap of the hearing protection cap.

13. An arrangement according to claim 11 including a cover mounted on the second strap support plate, wherein the side wall of the second strap support plate and the cover have complementary sealing portions which engage to form a seal between the side wall and the cover.

14. An arrangement according to claim 13 wherein the sealing portions comprise a sealing groove formed in the side wall and a sealing boss formed on the cover.

15. An arrangement according to claim 7 wherein the strap of the hearing protection cap has an end formed with a first trip edge engaging the spring bar when the hearing protection cap is in the first position, a second trip edge engaging the spring bar when the hearing protection cap is in the second position, and a sliding surface separating the first and second trip edges, the spring bar being increasingly deflected by the sliding surface as the hearing protection cap pivots between the first and second positions.

16. An arrangement according to claim 15 wherein the second strap support plate includes a stop face limiting pivoting of the hearing protection cap towards the ear of the wearer of the helmet.

17. An arrangement according to claim 15 wherein the spring bar urges the hearing protection cap to pivot towards the ear of the wearer of the helmet when the hearing protection cap is in its first position.

18. An arrangement according to claim 15 wherein the spring bar urges the hearing protection cap to pivot away from the ear of the wearer of the helmet when the hearing protection cap is in its second position.

19. An arrangement according to claim 6 including a cover mounted on the second strap support plate and including an opening through which the hearing protection cap can pass as it moves to the second position and a surface for limiting the pivoting movement of the hearing protection cap away from the ear of the wearer of the helmet.

20. An arrangement according to claim 8 wherein the first strap support plate, the second strap support plate, and the cover are each a one-piece plastic molding.

21. A modular head protection arrangement comprising:

a protective helmet;

a one-piece first strap support plate detachably mounted on a lateral side of the helmet and having a first side facing the helmet, a second side facing away from the helmet, a coupling cam formed on the first side of the plate and having a multisided outer contour, and a pin projecting from the second side of the plate;

a one-piece second strap support plate pivotably and detachably mounted on the pin of the first strap support plate;

a one-piece cover detachably mounted on the pin over the second strap support plate and restricting movement of the second strap support plate in an axial direction of the pin;

a face-protection shield including a strap having a claw for grasping the coupling cam and having a multisided inner contour complementary to the outer contour of the coupling cam, the shield being pivotable about the cam between a raised position and a lowered position in which the shield protects a face of a wearer of the helmet and being stably locked in either position by engagement between the cam and the claw; and a hearing protection cap for protecting an ear of the wearer of the helmet and including a strap pivotably supported by the second strap support plate for movement towards and away from the ear of the wearer of the helmet between a first position in which the hearing protection cap covers the ear of the wearer and a second position in which the hearing protection cap is spaced from the ear of the wearer.

* * * * *